US007321293B2

(12) United States Patent
Kennedy et al.

(10) Patent No.: US 7,321,293 B2
(45) Date of Patent: Jan. 22, 2008

(54) INTEGRATED MAGNETIC RANGING TOOL

(75) Inventors: Timothy Wayne Kennedy, Leduc (CA); Rodney Alan Schnell, Calgary (CA); Bryan Armand Vandal, Calgary (CA)

(73) Assignee: Halliburton Energy Services, Inc., Houston, TX (US)

( * ) Notice: Subject to any disclaimer, the term of this patent is extended or adjusted under 35 U.S.C. 154(b) by 212 days.

(21) Appl. No.: 11/133,182

(22) Filed: May 20, 2005

(65) Prior Publication Data

US 2006/0028321 A1 Feb. 9, 2006

(30) Foreign Application Priority Data

Aug. 6, 2004 (CA) ..... 2476787

(51) Int. Cl.
*G08B 3/14* (2006.01)

(52) U.S. Cl. ..... 340/385.1; 340/686.1; 175/40

(58) Field of Classification Search ..... 340/385.1, 340/686.1; 175/45, 40, 73, 61, 4.51; 166/66.5, 166/255.2; 324/326, 233
See application file for complete search history.

(56) References Cited

U.S. PATENT DOCUMENTS 3,104,295 A 9/1963 Bender et al.
3,704,749 A 12/1972 Estes et al.
3,964,553 A 6/1976 Basham et al.
4,323,848 A 4/1982 Kuckes
4,372,398 A 2/1983 Kuckes
4,410,051 A 10/1983 Daniel et al.
4,443,762 A 4/1984 Kuckes
4,502,010 A 2/1985 Kuckes
4,529,939 A 7/1985 Kuckes
4,593,770 A 6/1986 Hoehn, Jr.
4,621,698 A 11/1986 Pittard et al.
4,682,421 A 7/1987 Van Dongen et al.
4,700,142 A 10/1987 Kuckes
4,791,373 A 12/1988 Kuckes
4,802,150 A * 1/1989 Russell et al. ..... 367/85
4,845,434 A 7/1989 Kuckes et al.
4,933,640 A 6/1990 Kuckes
5,002,137 A 3/1991 Dickinson et al.
5,074,365 A 12/1991 Kuckes (Continued)

FOREIGN PATENT DOCUMENTS

CA 2114752 8/1983

(Continued)

OTHER PUBLICATIONS

Grills, Tracy L., "Magnetic Ranging Technologies for Drilling Steam Assisted Gravity Drainage Well Pairs and Unique well Geometries . . . ," SPE/Petroleum Society of CIP/CHOA79005.

*Primary Examiner*—Anh V. La
(74) *Attorney, Agent, or Firm*—Terrence N. Kuharchuk; William Shull; Clive D. Menezes

(57) ABSTRACT

An improvement in a tool of the type which is adapted for connection into a drilling string, which tool is adapted to perform a function in the drilling string as a first function. The improvement is a magnetic field source incorporated with the tool so that the tool is adapted to perform a magnetic field source carrying function as a second function. The first function is unrelated directly to the second function.

34 Claims, 6 Drawing Sheets

U.S. PATENT DOCUMENTS

| | | | | |
|---|---|---|---|---|
| 5,103,177 | A | 4/1992 | Russell et al. | |
| 5,165,490 | A | 11/1992 | Nosaka | |
| 5,218,301 | A | 6/1993 | Kuckes | |
| 5,258,755 | A | 11/1993 | Kuckes | |
| 5,305,212 | A | 4/1994 | Kuckes | |
| 5,343,152 | A | 8/1994 | Kuckes | |
| 5,435,069 | A | 7/1995 | Nicholson | |
| 5,449,048 | A | 9/1995 | Thigpen et al. | |
| 5,485,089 | A | 1/1996 | Kuckes | |
| 5,512,830 | A | 4/1996 | Kuckes | |
| 5,513,710 | A | 5/1996 | Kuckes | |
| 5,515,931 | A | 5/1996 | Kuckes | |
| 5,582,248 | A | 12/1996 | Estes | |
| 5,589,775 | A | 12/1996 | Kuckes | |
| 5,657,826 | A | 8/1997 | Kuckes | |
| 5,676,212 | A | 10/1997 | Kuckes | |
| 5,725,059 | A | 3/1998 | Kuckes et al. | |
| 5,787,997 | A | 8/1998 | Hartmann | |
| 5,806,194 | A | 9/1998 | Rodney et al. | |
| 5,923,170 | A | 7/1999 | Kuckes | |
| RE36,569 | E | 2/2000 | Kuckes | |
| 6,087,750 | A * | 7/2000 | Raad | 310/152 |
| 6,095,262 | A | 8/2000 | Chen | |
| 6,234,259 | B1 | 5/2001 | Kuckes et al. | |
| 6,326,785 | B1 * | 12/2001 | Kruspe | 324/303 |
| 6,411,087 | B1 * | 6/2002 | Fan et al. | 324/303 |
| 6,466,020 | B2 | 10/2002 | Kuckes et al. | |
| 6,617,854 | B2 | 9/2003 | Mercer et al. | |
| 6,736,222 | B2 | 5/2004 | Kuckes et al. | |
| 2002/0130663 | A1 | 9/2002 | Kuckes et al. | |

FOREIGN PATENT DOCUMENTS

| | | |
|---|---|---|
| CA | 2118305 | 10/1983 |
| CA | 1165854 | 4/1984 |
| CA | 1174276 | 9/1984 |
| CA | 1175106 | 9/1984 |
| CA | 1183207 | 2/1985 |
| CA | 2187487 | 6/1997 |
| CA | 2279539 | 12/2000 |
| CA | 2417555 | 7/2003 |
| GB | 2132769 | 7/1984 |
| WO | WO 98/45733 | 10/1998 |
| WO | WO 99/19751 | 4/1999 |
| WO | WO 01/11191 | 2/2001 |

* cited by examiner

INTEGRATED MAGNETIC RANGING TOOL

TECHNICAL FIELD

A tool for carrying a magnetic field source and for performing at least one other function in a drilling string.

BACKGROUND OF THE INVENTION

Magnetic ranging is a general term which is used to describe a variety of techniques which use magnetic measurements to determine the relative position (i.e., relative orientation and/or separation distance) of a borehole being drilled relative to a target such as another borehole or boreholes.

Determining the relative positions of two or more boreholes may be important in order to avoid intersection between boreholes, in order to achieve intersection of boreholes, or in order to achieve a desired relative position between boreholes.

It may be desirable to avoid intersection between boreholes when drilling a borehole in an area which is already crowded with other boreholes.

It may be desirable to achieve intersection between boreholes when drilling relief boreholes, drilling underground passages such as river crossings, or when linking a new borehole with a producing wellbore.

It is desirable to achieve a desired relative position between boreholes when employing steam assisted gravity drainage (SAGD) technology. SAGD technology involves the creation of a an upper borehole and a lower borehole which are essentially parallel to each other and are positioned essentially in a common vertical plane. The injection of steam into the upper borehole reduces the viscosity of hydrocarbons which are contained in the formations adjacent to the upper borehole and enables the hydrocarbons to flow due to gravity toward the lower borehole. The hydrocarbons may then be produced from the lower borehole using conventional production techniques.

In order for SAGD technology to be used effectively, careful control must be maintained during the creation of the pair of boreholes with respect to both the relative orientation of the boreholes and the separation distance between the boreholes. This control can be achieved using magnetic ranging techniques.

Magnetic ranging techniques include both "passive" techniques and "active" techniques. In both cases, the position of a borehole being drilled is compared with the position of a target such as a target borehole or some other reference such as ground surface. A discussion of both passive magnetic ranging techniques and active magnetic ranging techniques may be found in Grills, Tracy, "Magnetic Ranging Techniques for Drilling Steam Assisted Gravity Drainage Well Pairs and Unique Well Geometries—A Comparison of Technologies", SPE/Petroleum Society of CIM/CHOA 79005, 2002.

Passive magnetic ranging techniques, sometimes referred to as magnetostatic techniques, typically involve the measurement of residual or remnant magnetism in a target borehole using a measurement device or devices which are placed in a borehole being drilled.

An advantage of passive magnetic ranging techniques is that they do not typically require access into the target borehole since the magnetic measurements are taken of the target borehole "as is". One disadvantage of passive magnetic ranging techniques is that they do require relatively accurate knowledge of the local magnitude and direction of the earth's magnetic field, since the magnetic measurements which are taken represent a combination of the magnetism inherent in the target borehole and the local values of the earth's magnetic field. A second disadvantage of passive magnetic ranging techniques is that they do not provide for control over the magnetic fields which give rise to the magnetic measurements.

Active magnetic ranging techniques commonly involve the measurement, in one of a target borehole or a borehole being drilled, of one or more magnetic fields which are created in the other of the target borehole or the borehole being drilled.

A disadvantage of active magnetic ranging techniques is that they do typically require access into the target borehole in order either to create the magnetic field or fields or to make the magnetic measurements. One advantage of active magnetic ranging techniques is that they offer full control over the magnetic field or fields being created. Specifically, the magnitude and geometry of the magnetic field or fields can be controlled, and varying magnetic fields of desired frequencies can be created. A second advantage of active magnetic ranging techniques is that they do not typically require accurate knowledge of the local magnitude and direction of the earth's magnetic field because the influence of the earth's magnetic field can be cancelled or eliminated from the measurements of the created magnetic field or fields.

As a result, active magnetic ranging techniques are generally preferred where access into the target borehole is possible, since active magnetic ranging techniques have been found to be relatively reliable, robust and accurate.

One active magnetic ranging technique involves the use of a varying magnetic field source. The varying magnetic field source may be comprised of an electromagnet such as a solenoid which is driven by a varying electrical signal such as an alternating current in order to produce a varying magnetic field. Alternatively, the varying magnetic field source may be comprised of a permanent magnet which is rotated in order to generate a varying magnetic field.

In either case, the specific characteristics of the varying magnetic field enable the magnetic field to be distinguished from other magnetic influences which may be present due to residual magnetism in the borehole or due to the earth's magnetic field. In addition, the use of an alternating magnetic field in which the polarity of the magnetic field changes periodically facilitates the cancellation or elimination from measurements of constant magnetic field influences such as residual magnetism in the borehole or the earth's magnetic field.

The varying magnetic field may be generated in the target borehole, in which case the varying magnetic field is measured in the borehole being drilled. Alternatively, the varying magnetic field may be generated in the borehole being drilled, in which case the varying magnetic field is measured in the target borehole.

The varying magnetic field may be configured so that the "axis" of the magnetic field is in any orientation relative to the borehole. Typically, the varying magnetic field is configured so that the axis of the magnetic field is oriented either parallel to the borehole or perpendicular to the borehole.

U.S. Pat. No. 4,621,698 (Pittard et al) describes a percussion boring tool which includes a pair of coils mounted at the back end thereof. One of the coils produces a magnetic field parallel to the axis of the tool and the other of the coils produces a magnetic field transverse to the axis of the tool. The coils are intermittently excited by a low frequency generator. Two crossed sensor coils are positioned remote of the tool such that a line perpendicular to the axes of the sensor coils defines a boresite axis. The position of the tool relative to the boresite axis is determined using magnetic measurements obtained from the sensor coils of the magnetic fields produced by the coils mounted in the tool.

U.S. Pat. No. 5,002,137 (Dickinson et al) describes a percussive action mole including a mole head having a slant face, behind which slant face is mounted a transverse permanent magnet or an electromagnet. Rotation of the mole results in the generation of a varying magnetic field by the magnet, which varying magnetic field is measured at the ground surface by an arrangement of magnetometers in order to obtain magnetic measurements which are used to determine the position of the mole relative to the magnetometers.

U.S. Pat. No. 5,258,755 (Kuckes) describes a magnetic field guidance system for guiding a movable carrier such as a drill assembly with respect to a fixed target such as a target borehole. The system includes two varying magnetic field sources which are mounted within a drill collar in the drilling assembly so that the varying magnetic field sources can be inserted in a borehole being drilled. One of the varying magnetic field sources is a solenoid axially aligned with the drill collar which generates a varying magnetic field by being driven by an alternating electrical current. The other of the varying magnetic field sources is a permanent magnet which is mounted so as to be perpendicular to the axis of the drill collar and which rotates with the drill assembly to provide a varying magnetic field. The system further includes a three component fluxgate magnetometer which may be inserted in a target borehole in order to make magnetic measurements of the varying magnetic fields generated by the varying magnetic field sources. The position of the borehole being drilled relative to the target is determined by processing the magnetic measurements derived from the two varying magnetic field sources.

U.S. Pat. No. 5,589,775 (Kuckes) describes a method for determining the distance and direction from a first borehole to a second borehole which includes generating, by way of a rotating magnetic field source at a first location in the second borehole, an elliptically polarized magnetic field in the region of the first borehole. The method further includes positioning sensors at an observation point in the first borehole in order to make magnetic measurements of the varying magnetic field generated by the rotating magnetic field source. The magnetic field source is a permanent magnet which is mounted in a non-magnetic piece of drill pipe which is located in a drill assembly just behind the drill bit. The magnet is mounted in the drill pipe so that the north-south axis of the magnet is perpendicular to the axis of rotation of the drill bit. The distance and direction from the first borehole to the second borehole are determined by processing the magnetic measurements derived from the rotating magnetic field source.

In U.S. Pat. No. 4,621,698 (Pittard et al) the magnetic field sources are located at the back end or behind a percussion boring tool. In U.S. Pat. No. 5,002,137 (Dickinson et al) the magnetic field source is located within a percussive action mole.

In U.S. Pat. No. 5,258,755 (Kuckes) the magnetic field sources are located within a conventional drill collar which is behind a drill assembly which comprises a drill bit and a drilling motor. In U.S. Pat. No. 5,589,775 (Kuckes) the magnetic field source is located in a piece of drill pipe which is between a drill bit and a drilling motor.

There remains a need for a tool for connection into a drilling string which is adapted to perform at least one function in the drilling string in addition to providing and carrying a magnetic field source. In addition, there remains a need for such a tool for connection into a drilling string wherein the drilling string includes a rotary drill bit.

SUMMARY OF THE INVENTION

The present invention is a tool which is adapted for connection into a drilling string, which tool is adapted to perform at least two functions in the drilling string. The functions include a first function and a second function, wherein the second function is a magnetic field source carrying function, and wherein the first function is unrelated directly to the magnetic field source carrying function. The tool is thus an integrated magnetic ranging tool which combines the first function and the second function into a single tool. In some embodiments, the tool is preferably adapted for connection into a drilling string which includes a rotary drill bit.

In a first aspect, the invention is an improvement in a tool adapted for connection into a drilling string, wherein the tool is adapted to perform a first function in the drilling string, in which the improvement comprises a magnetic field source incorporated with the tool so that the tool is adapted to perform a second function in the drilling string, wherein the second function is a magnetic field source carrying function, and wherein the first function is unrelated directly to the magnetic field source carrying function.

In a second aspect, the drilling string is comprised of a rotary drill bit and the tool is adapted for connection into the drilling string for use in drilling with the rotary drill bit.

The first function may be comprised of any function which is unrelated directly to the magnetic field source carrying function and which is not merely the function of providing a length of drill pipe or a length of drill collar in which to carry the magnetic field source.

In other words, the tool is capable of performing a drilling related function which is separate from the magnetic field source carrying function so that the tool does not add superfluous length to the drilling string in order to perform the magnetic field source carrying function. As a result, preferably the length of the tool is not increased as a result of its adaptation to perform the magnetic field source carrying function.

The tool may be defined by the first function. As a first example, the tool may be a stabilizer, in which case the first function is a stabilizing function. As a second example, the tool may be a reamer, in which case the first function is a reaming function. As a third example, the tool may be a rotary drill bit, in which case the first function is a drilling function. As a fourth example, the tool may be a drill bit connector such as a bit box, in which case the first function is a drill bit connecting function.

As a fifth example, the tool may be a drilling motor or a component or sub-component thereof, in which case the first function is a drill bit driving function. Representative components of the drilling motor which may be adapted to perform the magnetic field source carrying function include a dump sub, a power section, a transmission, a driveshaft, a bearing section, a saver sub, a drilling motor housing and a bent sub. Representative sub-components of the drilling motor which may be adapted to perform the magnetic field source carrying function include a stator, a rotor, a universal joint and a flex joint.

As a sixth example, the tool may be comprised of a steering device or a component or sub-component thereof, in which case the first function is a steering function. As a seventh example, the tool may be a communication tool such as a measurement-while-drilling device, in which case the first function is a communication function.

The magnetic field source may be comprised of a single magnet or may be comprised of a plurality of magnets. A magnet for use in the invention may be comprised of an electromagnet (such as a solenoid) or a permanent magnet and a plurality of magnets may include only electromagnets, only permanent magnets, or may include a combination of electromagnets and permanent magnets. In preferred embodiments, the magnetic field source is comprised of a plurality of permanent magnets. Permanent magnets used in the invention may be any size and may be relatively flat or may be elongated.

The magnetic field source has a magnetic field source axis which is defined by its magnetic poles. Each electromagnet and permanent magnet therefore has a magnet axis which is defined by its magnetic poles. The tool defines a tool axis which generally represents an axis of rotation of the tool when it is connected into the drilling string.

The magnetic field source axis and each magnet axis may be oriented in any direction relative to the tool axis, depending upon the intended geometry of the magnetic field generated by the magnetic field source. Different magnets may be oriented in different directions relative to the tool axis, or all magnets may be oriented in the same direction relative to the tool axis. The magnets may also be aligned so that they are in a common polar direction or they may be aligned so that their polar directions are reversed. In preferred embodiments, all magnets are incorporated with the tool so that they are oriented in the same direction relative to the tool axis and so that they are aligned in a common polar direction.

Preferably the magnetic field source axis and each magnet axis is oriented such that they are either substantially parallel to the tool axis or substantially perpendicular to the tool axis. For example, some magnets may be oriented so that their magnet axes are substantially parallel to the tool axis while other magnets may be oriented so that their magnet axes are substantially perpendicular to the tool axis.

In preferred embodiments, the plurality of magnets is each incorporated with the tool such that each magnet axis is substantially perpendicular to the tool axis, so that rotation of the tool about the tool axis results in the generation of an alternating magnetic field by the magnets.

The magnetic field source may be incorporated with the tool in any manner which will result in an integrated tool which is capable of performing both the first function and the second function. For example, magnets may be integrally formed with the tool, or magnets may be mounted on or within the tool in order to incorporate the magnetic field source with the tool. Magnets may be mounted on or within the tool in any suitable manner which will facilitate retaining of the magnets by the tool without significant interference with the magnetic properties of the magnets.

The magnetic field source is preferably incorporated with the tool such that it is substantially isolated from materials which have a relatively high magnetic permeability. Isolating the magnetic field source from magnetic materials facilitates improved control over the characteristics of the magnetic field or fields generated by the magnetic field source.

More particularly, the magnetic field source is preferably incorporated with the tool so that it is substantially surrounded by a relatively non-magnetic material. In some preferred embodiments, the entire tool may be constructed of a relatively non-magnetic material. Any relatively non-magnetic material which is suitable for use in the tool may be used. In preferred embodiments, a suitable non-magnetic material is non-magnetic steel.

In a first preferred embodiment the tool is a stabilizer, so that the first function is a stabilizing function. The stabilizer may be comprised of any suitable stabilizer tool. Preferably the stabilizer is a rotating type stabilizer with stabilizer members that rotate with the stabilizer body during use. The stabilizer may also perform an ancillary reaming function as part of the first function.

Alternatively, as a variation of the first preferred embodiment the tool may be comprised of a reamer so that the first function is a reaming function. The reamer may also perform an ancillary stabilizing function as part of the first function. The reamer may be comprised of any suitable reamer tool, including a blade-type reamer, roller reamer, etc.

For the purposes of the invention, the term "stabilizer" includes both stabilizers and reamers, due to the general structural similarities between stabilizers and reamers.

The stabilizer defines a stabilizer axis, is comprised of a stabilizer body, and is further comprised of a plurality of stabilizer members such as stabilizer blades spaced circumferentially around the stabilizer body. The stabilizer members define stabilizer grooves spaced circumferentially between the stabilizer members. The stabilizer members may be integrally formed with the stabilizer body or may otherwise be mounted on the stabilizer body. The stabilizer body defines a stabilizer bore therethrough which is generally parallel with the stabilizer axis.

The stabilizer is preferably constructed entirely or substantially from a relatively non-magnetic material such as non-magnetic steel.

In the first preferred embodiment, the magnetic field source is preferably comprised of a plurality of permanent magnets. The permanent magnets may be relatively flat or may be elongated. Preferably the magnets are incorporated with the stabilizer such that the magnet axes of all of the magnets are both substantially parallel to each other and substantially perpendicular to the stabilizer axis, and preferably each of the magnets is aligned in a common polar direction.

The plurality of magnets may be incorporated with the stabilizer at any location on or within the stabilizer. For example, the magnets may be mounted or retained on or within the stabilizer body, the stabilizer members or the stabilizer grooves. If the magnets are elongated, the magnets are preferably mounted or retained on or within the stabilizer body so that they extend transversely through the stabilizer body between two of the stabilizer grooves and so that they pass radially between the stabilizer bore and at least one of the stabilizer members. This enables the magnets to be incorporated with the stabilizer without increasing the length of the stabilizer and allows the magnets to be protected by the stabilizer members.

Most preferably the plurality of magnets is comprised of a first magnet array of elongated permanent magnets which extends transversely through the stabilizer body between a first pair of the stabilizer grooves and most preferably the plurality of magnets is further comprised of a second magnet array of elongated permanent magnets which extends transversely through the stabilizer body between a second pair of the stabilizer grooves.

In a second preferred embodiment, the drilling string includes a rotary drill bit and the tool is the rotary drill bit, so that the first function is a drilling function. The drill bit may be comprised of any suitable rotary drill bit, including a roller cone bit, a fixed cutter bit such as a natural diamond bit or a polycrystalline diamond (PDC) bit, and a coring bit.

The drill bit is preferably comprised of a plurality of fixed or movable rotary cutting elements located adjacent to a distal end of the drill bit, a threaded connector located adjacent to a proximal end of the drill bit, and a shank located between the distal end of the drill bit and the proximal end of the drill bit. The drill bit may be further comprised of one or more "junk slots" or longitudinal grooves or longitudinal recesses in an exterior surface of the drill bit which allow for circulating fluid and debris to move past the drill bit. The drill bit defines a drill bit axis and defines a drill bit bore which extends through the drill bit generally parallel with the drill bit axis.

The drill bit is preferably constructed entirely or substantially from a relatively non-magnetic material such as non-magnetic steel.

In the second preferred embodiment, the magnetic field source is preferably incorporated with the drill bit such that the magnetic field source axis is substantially perpendicular to the drill bit axis. Preferably, the magnetic field source is comprised of a plurality of permanent magnets. The permanent magnets may be relatively flat or may be elongated. Preferably the magnets are incorporated with the drill bit such that the magnet axes of all of the magnets are both substantially parallel to each other and substantially perpendicular to the drill bit axis, and preferably each of the magnets is aligned in a common polar direction.

The plurality of magnets may be incorporated with the drill bit at any location on or within the drill bit. For example, the magnets may be mounted or retained on or within the drill bit amongst the cutting elements, along the shank, or even along the threaded connector. The magnets may be mounted within a recess on the exterior surface of the drill bit so that the magnets are protected during use of the drill bit. If the magnets are elongated, the magnets are preferably mounted so that they extend transversely through the drill bit between two junk slots and so that they pass radially between the drill bit bore and a full diameter portion of the drill bit. This enables the magnets to be incorporated with the drill bit without increasing the length of the drill bit and allows the magnets to be protected by the full diameter portion of the drill bit.

In a third preferred embodiment, the tool is a drilling motor, so that the first function is a drill bit driving function. The drilling motor may be comprised of any type of drilling motor which is suitable for use in a drilling string, but is preferably a rotary drilling motor such as a positive displacement motor (PDM) or a turbine motor.

The drilling motor is most preferably a positive displacement motor (PDM) which comprises a power section having a helically lobed rotor and a helically lobed stator and a driveshaft connected with the rotor. The drilling motor may also include other components and sub-components such as a dump sub, a transmission, a flex joint, a bearing section, a saver sub, a bent sub, a drill bit connector and a drilling motor housing. The drilling motor defines a drilling motor axis.

In the third preferred embodiment, the magnetic field source is preferably comprised of a plurality of permanent magnets. The permanent magnets may be relatively flat or may be elongated. Preferably the magnets are incorporated with the drilling motor such that the magnet axes of all of the magnets are both substantially parallel to each other and substantially perpendicular to the drilling motor axis, and preferably each of the magnets is aligned in a common polar direction.

The plurality of magnets may be incorporated with the drilling motor at any location on or within the drilling motor, including on or within any component or sub-component of the drilling motor. For example, the magnets may be mounted or retained on or within a rotor, a stator, a driveshaft, a dump sub, a transmission, a flex joint, a bearing section, a saver sub, a bent sub, a drill bit connector and a drilling motor housing.

Preferably the magnets are incorporated with the drilling motor so that they are substantially surrounded by a relatively non-magnetic material. Alternatively or additionally, the magnets may be mounted on or within a component or a sub-component of the drilling motor which is constructed substantially from a relatively non-magnetic material such as non-magnetic steel.

The concepts applicable to the preferred embodiments described above may be applied to other tools which are adapted for connection into a drilling string in order to produce a tool which performs a magnetic field source carrying function and at least one other function in the drilling string.

BRIEF DESCRIPTION OF DRAWINGS

Embodiments of the invention will now be described with reference to the accompanying drawings, in which.

DETAILED DESCRIPTION

The present invention generally relates to a tool which is adapted for connection into a drilling string and which is adapted to perform at least two functions in the drilling string. A first function is related generally to the drilling functions of the drilling string. A second function is specifically a magnetic field source carrying function.

The first function is unrelated directly to the second function. In other words, the first function is not merely to house the magnetic field source or to otherwise support the magnetic field source carrying function.

The invention enables tools which may be used for specific purposes in a drilling string to be useful also in the performance of magnetic ranging techniques, thus eliminating the need to incorporate a separate magnetic ranging tool into the drilling string in order to perform magnetic ranging techniques.

Figure 1:
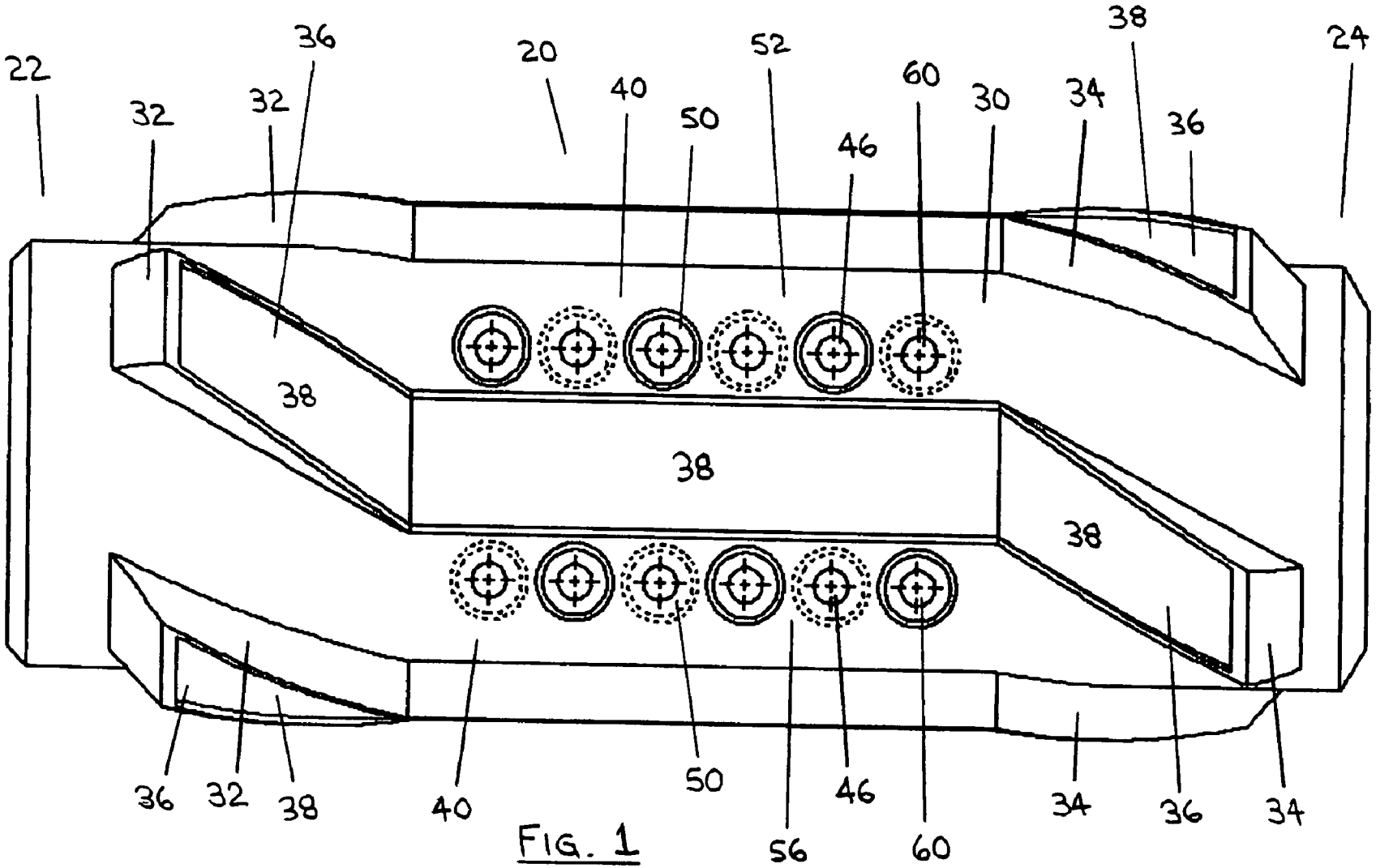
FIG. 1 is a side view of a stabilizer according to a preferred embodiment of the invention.
Figure 2:
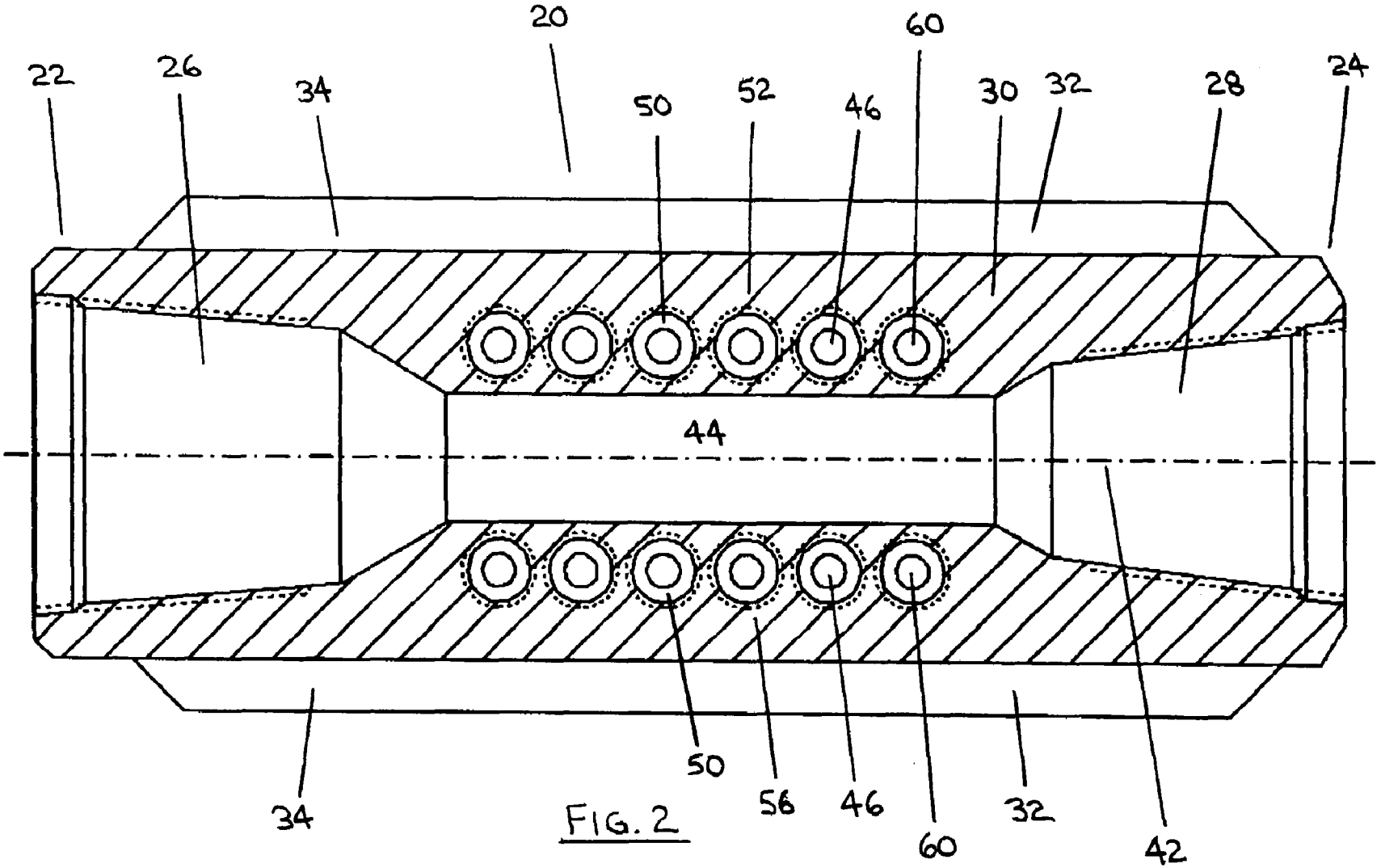
FIG. 2 is a longitudinal section view of the stabilizer depicted in FIG. 1.
Figure 3:
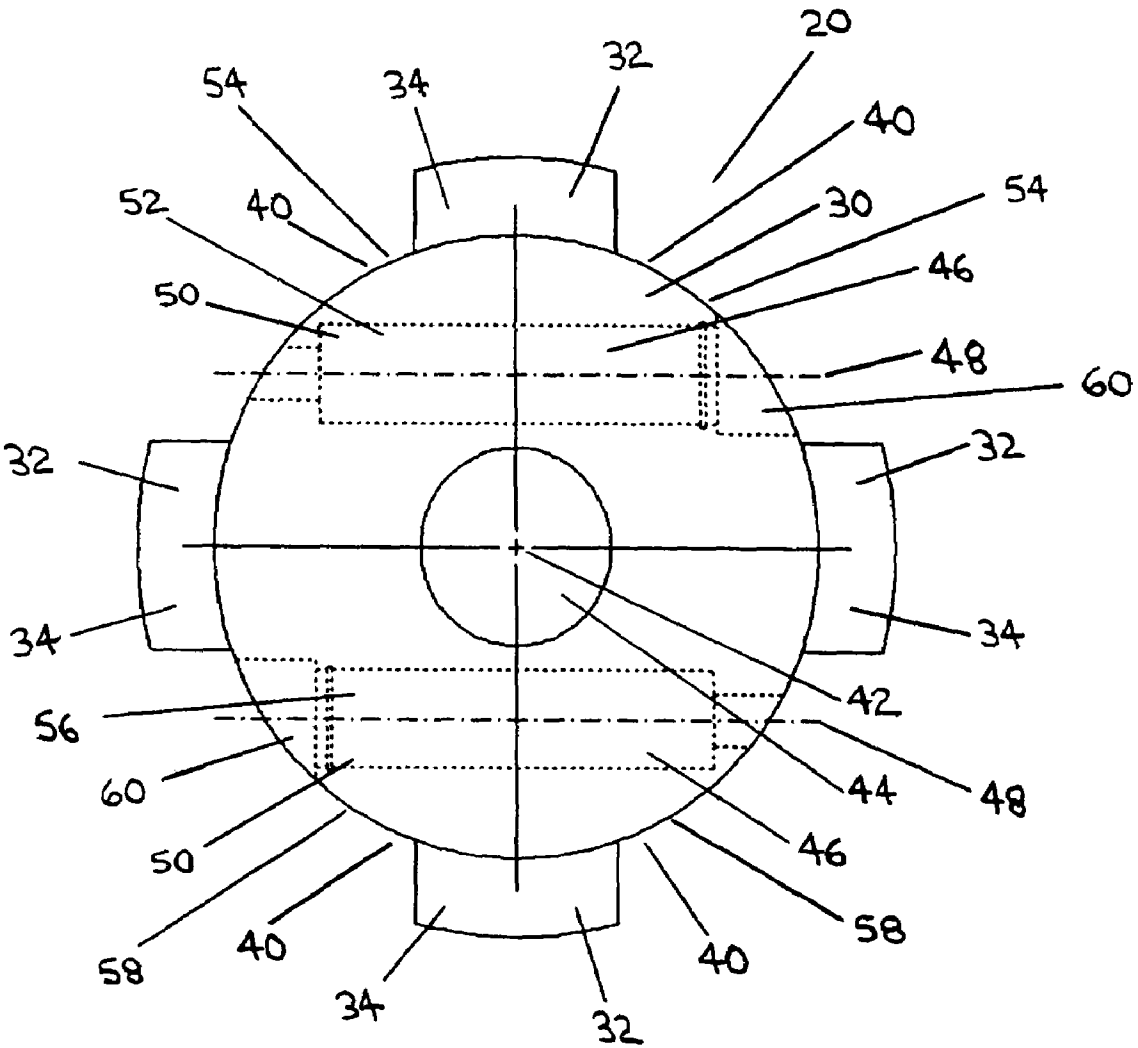
FIG. 3 is a transverse section view of the stabilizer depicted in FIG. 1.

Referring to FIGS. 1-3, a first preferred embodiment is depicted in which the tool is a stabilizer (20) and the first function is a stabilizing function. The stabilizer (20) may also perform an ancillary reaming function, or the stabilizer (20) may serve primarily as a reamer and perform an ancillary stabilizing function. Finally, the stabilizer (20) may serve exclusively as a reamer, and thus perform little or no ancillary stabilizing function.

Referring to FIG. 1, the stabilizer (20) includes an upper end (22) and a lower end (24). An upper threaded connector (26) is provided at the upper end (22) and a lower threaded connector (28) is provided at the lower end (24). The threaded connectors (26,28) facilitate the connection of the stabilizer (20) into a drilling string (not shown).

The stabilizer (20) as depicted in FIGS. 1-3 is intended for use as a near-bit stabilizer in a drilling string which includes a rotary steerable drilling assembly (not shown), which drilling assembly includes a pin-type connector for connecting a rotary drill bit (not shown) to the drilling assembly. The stabilizer (20) as depicted in FIGS. 1-3 is also intended for use with a rotary drill bit which has a pin-type connector for connecting the drill bit to the drilling assembly.

As a result, the upper threaded connector (26) and the lower threaded connector (28) are both box-type connectors so that the stabilizer (20) functions as an adapter for connecting the drill bit with the drilling assembly. Alternately, one or both of the upper connector (26) and the lower connector (28) may be comprised of a pin-type connector to facilitate connection of the stabilizer (20) with box-type connectors on the drilling string.

The stabilizer (20) includes a stabilizer body (30) and further includes a plurality of stabilizer members (32) which are spaced circumferentially around the stabilizer body (30). The stabilizer (20) may include any number of stabilizer members (32). In the preferred embodiment the stabilizer (20) is comprised of four stabilizer members (32).

The stabilizer members (32) are comprised of stabilizer blades (34). The stabilizer blades (34) include pockets (36) which accommodate the mounting of a hardfacing material (38) such as tungsten carbide therein in order to provide the stabilizer members with improved durability and wear resistance. As depicted in FIGS. 1-3, the stabilizer members (32) are integrally formed with the stabilizer body (30), but the stabilizer members (32) may alternatively be mounted on the stabilizer body (30) by welding, bolting or in some other manner.

The stabilizer members (32) and the stabilizer body (30) together define stabilizer grooves (40) which are spaced circumferentially around the stabilizer body (30) between the stabilizer members (32).

Referring to FIGS. 2-3, the stabilizer (20) defines a stabilizer axis (42) and the stabilizer body (30) defines a stabilizer bore (44). The stabilizer bore (44) extends through the stabilizer (20) from the upper end (22) to the lower end (24) and is generally parallel with the stabilizer axis (42).

In the preferred embodiment, the stabilizer (20) is constructed substantially from a relatively non-magnetic material such as non-magnetic steel.

The stabilizer (20) is adapted to perform a magnetic field source carrying function as a second function in addition to the stabilizing function as the first function. As a result, the magnetic field source is incorporated with the stabilizer (20) to provide an integrated tool which is adapted to perform both the stabilizing function and the magnetic field source carrying function.

The manner, location and extent to which the magnetic field source is incorporated with the stabilizer (20) will depend upon the nature of the magnetic field source.

If the magnetic field source is comprised of one or more electromagnets, a electrical source for energizing the electromagnet must be accommodated, with the result that a magnetic field source cavity (not shown) may be provided within the stabilizer body (30) in order to incorporate the components of the electromagnet with the stabilizer (20).

If the magnetic field source is comprised of one or more permanent magnets, the manner in which the permanent magnets are incorporated with the stabilizer (20) will depend to some extent upon the size and shape of the permanent magnets. If the permanent magnets are relatively flat, they may be incorporated with the stabilizer (20) by being mounted on the surface of the stabilizer body (30) or the stabilizer members (32). If the permanent magnets are elongated, they may be incorporated with the stabilizer (20) by being mounted or retained wholly or partly within the stabilizer body (30) or the stabilizer members (32).

In the preferred embodiment, the magnetic field source is comprised of a plurality of elongated permanent magnets (46). Each of the magnets (46) has a magnet axis (48) which is defined by the poles of the magnet (46).

The magnets (46) are retained in magnet sockets (50) which are formed in the stabilizer body (30). In the preferred embodiment the magnet sockets (50) are all substantially parallel to each other and are substantially perpendicular to the stabilizer axis (42). When the magnets (46) are positioned in the magnet sockets (50), they are also preferably oriented so that their magnet axes (48) are both substantially parallel to each other and substantially perpendicular to the stabilizer axis (42). The magnets (46) are also aligned in a common polar direction when they are positioned in the magnet sockets (50) so that the magnetic fields generated by the magnets (46) are additive and collectively define a magnetic field source axis which is parallel to the magnet axes (48).

Any number of the magnets (46) may be incorporated with the stabilizer (20). In the preferred embodiment, the magnet sockets (50) are configured to provide a first magnet array (52) which extends between a first pair (54) of the stabilizer grooves (40) and a second magnet array (56) which extends between a second pair (58) of the stabilizer grooves (40). Each of the magnet sockets (50) therefore passes radially between a stabilizer member (32) and the stabilizer bore (44) so that the magnets (46) are protected by the stabilizer members (32).

Alternatively, the magnet sockets (50) may be incorporated into the stabilizer members (32) so that the magnet sockets (50) are located within the thickest and strongest sections of the stabilizer (20).

As depicted in FIGS. 1-3, each of the first magnet array (52) and the second magnet array (56) is configured to accommodate a maximum number of six magnets (46), so that a maximum number of twelve magnets (46) as a magnetic field source can be incorporated with the stabilizer (20). It is not necessary that a magnet (46) be positioned in each magnet socket (50), with the result that fewer than twelve magnets (46) may be incorporated with the stabilizer (20).

In the preferred embodiment the number and positions of the magnet sockets (50) as described above is intended to accommodate incorporation of the magnets (46) with the stabilizer (20) without adding to the length of the stabilizer (20). This feature of the invention is of importance where the stabilizer (20) is intended to be located between a drilling assembly (such as a drilling motor or a rotary steerable device) and a drill bit, since any additional length between the drilling assembly and the drill bit will have an adverse effect upon angle build rates and upon the durability of the drilling assembly.

The magnet sockets (50) in each of the magnet arrays (52,56) are preferably formed by drilling holes in the stabilizer body (30). In the preferred embodiment, the magnet sockets (50) are drilled alternately from opposing sides in order to enable the magnets (46) to be inserted and removed from the magnet sockets (50) from opposing sides, thus simplifying servicing of the magnets (46) and the stabilizer (20).

The magnets (46) may be retained within the magnet sockets (50) in any suitable manner. For example, the magnets (46) may be secured within the magnet sockets (50) with an adhesive or by welding. Alternatively, the magnets (46) may be secured within the magnet sockets (50) by press fitting, shrink fitting or expansion fitting. Preferably the magnets (46) are retained in the magnet sockets (50) with releasable magnet retainers (60) such as retaining screws, plugs, lock rings, or snap rings. In the preferred embodiment the magnets (46) are retained within the magnet sockets (50) using releasable magnet retainers (60), which are preferably either spiral lock rings or snap rings.

Figure 4:
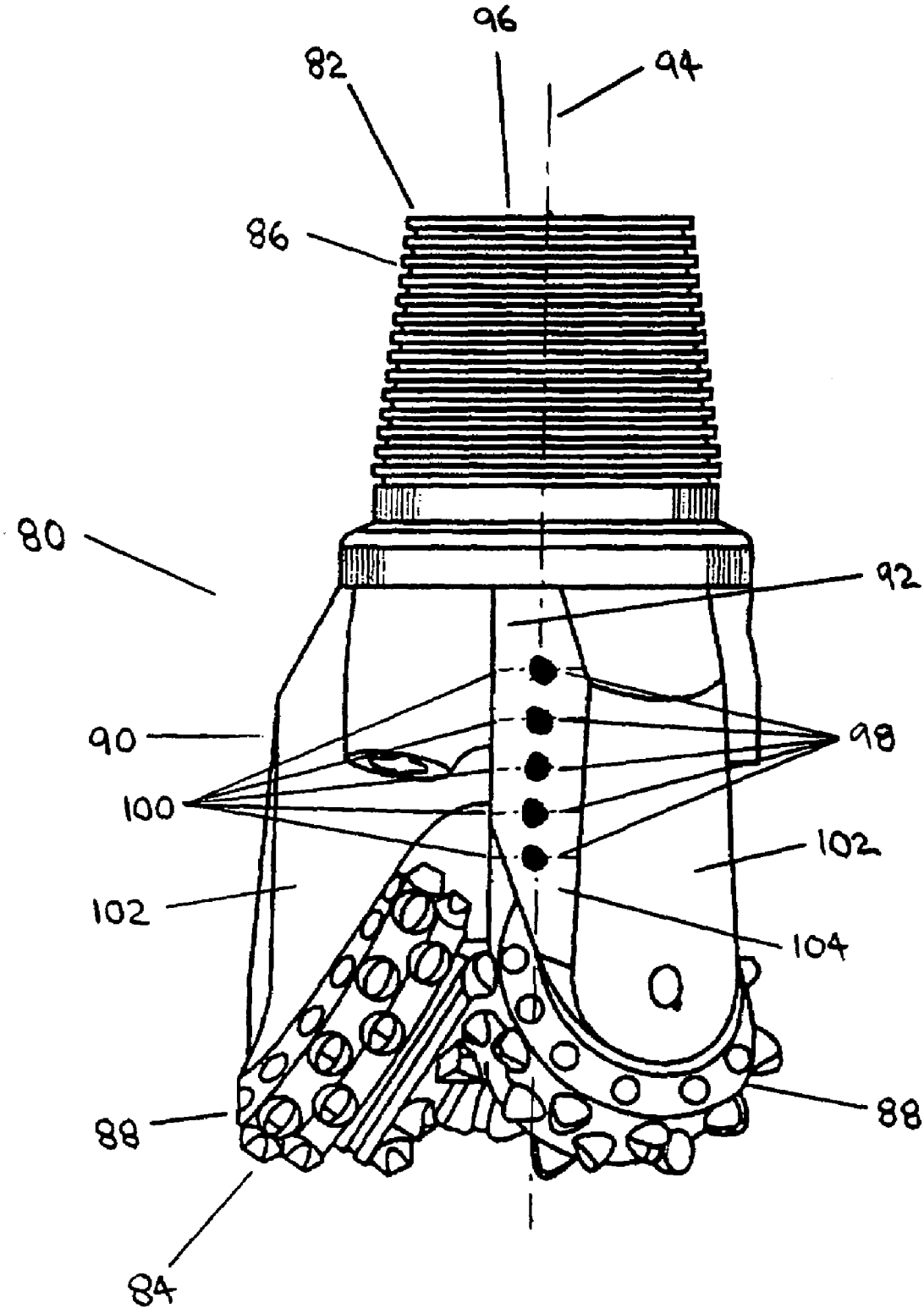
FIG. 4 is a side view of a roller cone type rotary drill bit according to a preferred embodiment of the invention.
Figure 5:
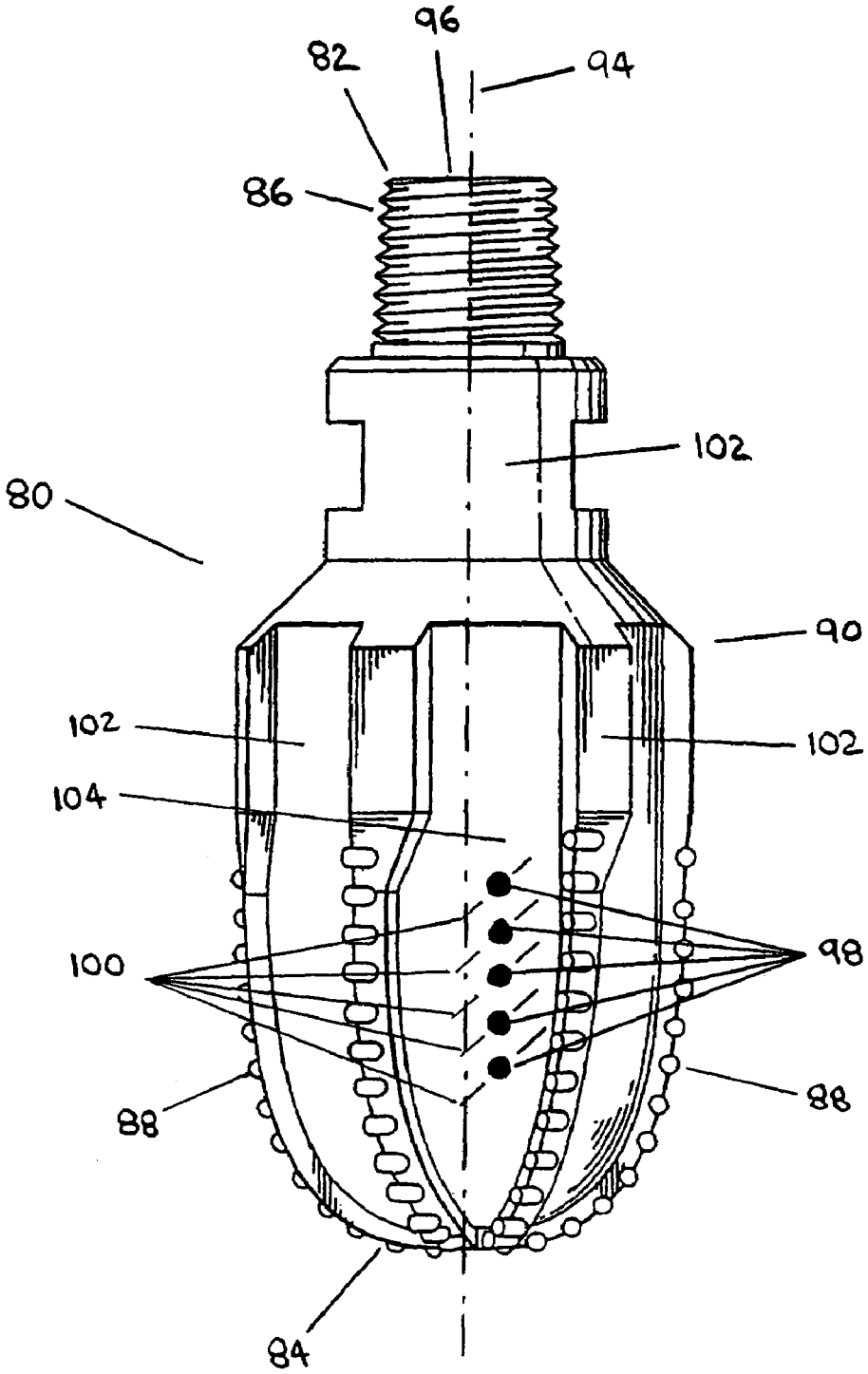
FIG. 5 is a side view of a fixed cutter type rotary drill bit according to a preferred embodiment of the invention.

Referring to FIGS. 4 and 5, a second preferred embodiment is depicted in which the tool is a rotary drill bit and the first function is a drilling function. In FIG. 4, the rotary drill bit is a roller cone type rotary drill bit. In FIG. 5, the rotary drill bit is a fixed cutter type rotary drill bit.

Referring to FIGS. 4 and 5, a rotary drill bit (80) includes a proximal end (82) and a distal end (84). A threaded connector (86) is provided at the proximal end (82) to facilitate the connection of the drill bit (80) into a drilling string. As depicted in FIGS. 4 and 5, the threaded connector (86) is a pin-type connector. Alternatively, the threaded connector (86) may be a box-type connector.

The drill bit (80) further includes a plurality of cutting elements (88) located adjacent to the distal end (84) of the drill bit (80), a shank (90) located between the proximal end (82) and the distal end (84), and a plurality of longitudinal recesses (92) along the shank (90) to allow for circulating fluid and debris to move past the drill bit (80).

In the drill bit (80) depicted in FIG. 4 the cutting elements (88) are comprised of roller cones. In the drill bit (80) depicted in FIG. 5 the cutting elements (88) are comprised of diamond inserts such as polycrystalline diamond (PDC) inserts.

The drill bit (80) defines a drill bit axis (94) and a drill bit bore (96) which extends through the drill bit (80) from the proximal end (82) to the distal end (84) and is generally parallel to the drill bit axis (94).

In the preferred embodiments depicted in FIG. 4 and FIG. 5 the drill bit (80) is constructed substantially from a relatively non-magnetic material such as non-magnetic steel.

The drill bit (80) is adapted to perform a magnetic field source carrying function as a second function in addition to the drilling function as the first function. As a result, a magnetic field source is incorporated with the drill bit (80) to provide an integrated tool which is adapted to perform both the drilling function and the magnetic field source carrying function.

As with the stabilizer (20), the manner, location and extent to which the magnetic field source is incorporated with the drill bit (80) will depend upon the nature of the magnetic field source. The considerations that apply in incorporating the magnetic field source with the stabilizer (20) will apply equally to incorporating the magnetic field source with the drill bit (80).

In the preferred embodiments of the drill bit (80) the magnetic field source is comprised of a plurality of permanent magnets (98). Each of the permanent magnets (98) has a magnet axis (100) which is defined by the poles of the magnet (98).

The magnets (98) may be relatively flat or may be elongated. If the magnets (98) are elongated, they may, for example, be retained in magnet sockets (not shown) in the same manner as the magnets (46) are retained in the magnet sockets (50) of the stabilizer (20).

As depicted in FIGS. 4 and 5, however, the magnets (98) are relatively flat and are mounted on an exterior surface (102) of the drill bit (80).

Preferably, the magnets (98) are mounted on a face (104) of one or more of the longitudinal recesses (92) so that they are relatively protected during use of the drill bit (80). Alternatively, the magnets (98) may be mounted on or within relatively thicker and stronger sections of the drill bit (80).

The magnets (98) may be mounted on the exterior surface (102) of the drill bit (80) in any suitable manner, including by way of an adhesive or by welding.

When the magnets (98) are incorporated with the drill bit (80) they are preferably oriented so that their magnet axes (100) are both substantially parallel to each other and substantially perpendicular to the drill bit axis (94). The magnets (98) are also preferably aligned in a common polar direction so that the magnetic fields generated by the magnets (98) are additive and collectively define a magnetic source axis which is parallel with the magnet axes (100).

The number and positions of the magnets (98) which are incorporated with the drill bit (80) is preferably selected to accommodate the incorporation of the magnets (98) with the drill bit (80) without adding to the length of the drill bit (80), in order to avoid adverse effects upon the angle build rate and durability of the drilling assembly.

Figure 6:
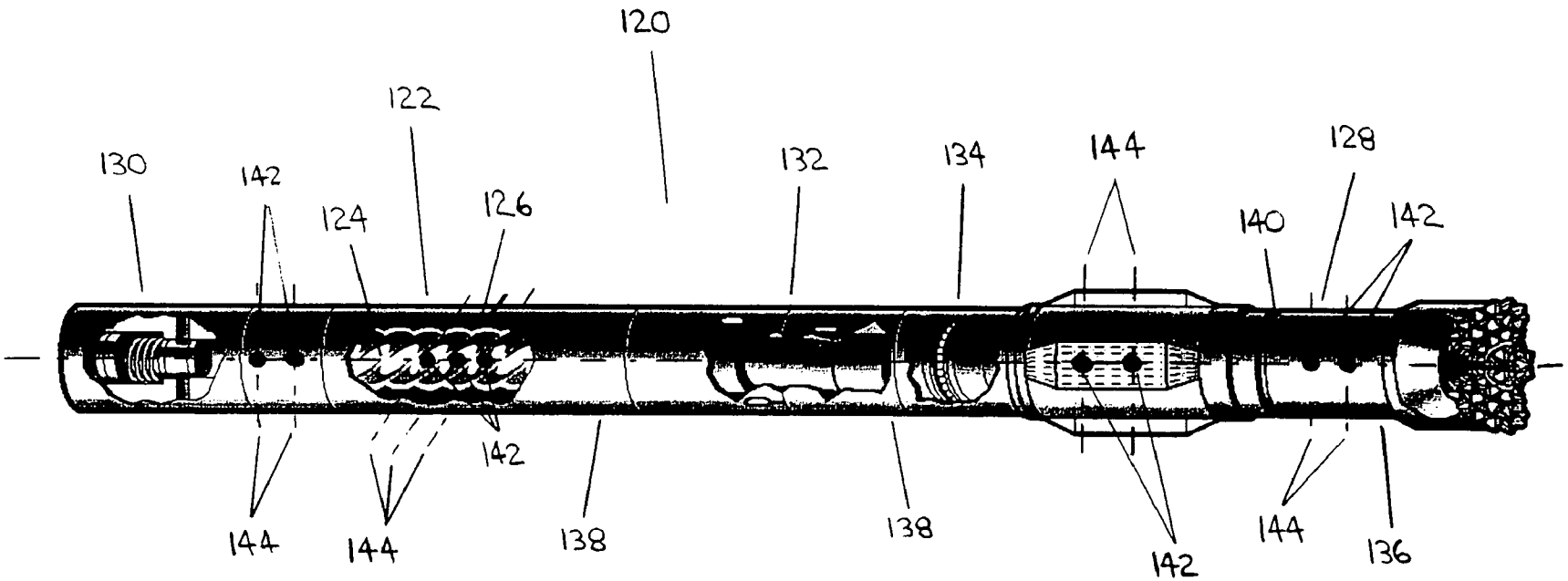
FIG. 6 is a side schematic view of a positive displacement drilling motor according to a preferred embodiment of the invention.

Referring to FIG. 6, a third preferred embodiment is depicted in which the tool is a drilling motor (120) and the first function is a drill bit driving function.

Referring to FIG. 6, the drilling motor (120) is a positive displacement motor (PDM) which comprises a power section (122) including a helically lobed rotor (124), a helically lobed stator (126), and a driveshaft (128) connected with the rotor (124). As depicted in FIG. 6, the drilling motor (120) also includes a dump sub (130), a transmission (132), a bearing section (134), a drill bit connector (136) and a drilling motor housing (138). The drilling motor (120) defines a drilling motor axis (140).

The drilling motor (120) is adapted to perform a magnetic field source carrying function as a second function in addition to the drill bit driving function as a first function. As a result, a magnetic field source is incorporated with the drilling motor (120) to provide an integrated tool which is adapted to perform both the drill bit driving function and the magnetic field source carrying function.

As with the stabilizer (20) and the drill bit (80), the manner, location and extent to which the magnetic field source is incorporated with the drilling motor (120) will depend upon the nature of the magnetic field source, and the considerations that apply in incorporating the magnetic field source with the stabilizer (20) and the drill bit (80) will apply equally to incorporating the magnetic field source with the drilling motor (120).

In preferred embodiments of the drilling motor (120) the magnetic field source is comprised of a plurality of permanent magnets (142). Each of the magnets (142) has a magnet axis (144) which is defined by the poles of the magnet (142).

The magnets (142) may be relatively flat or may be elongated. If the magnets are elongated, they may, for example, be retained in magnet sockets (not shown) in the same manner as the magnets (46) are retained in the magnet sockets (50) of the stabilizer (20). If the magnets are relatively flat, they may, for example, be mounted or retained on or within the drilling motor in the same manner as the magnets (98) are mounted on the drill bit (80).

The magnets (142) are shown schematically on FIG. 6 in order to indicate possible locations for incorporating the magnets with the drilling motor, and not in order to depict a particular preferred configuration for the magnets (142).

As can be seen in FIG. 6, the magnets (142) may be incorporated with any portion of the drilling motor (120) or with any component or sub-component of the drilling motor (120). In addition, the magnets may either be relatively flat or may be elongated.

Preferably the magnets (142) are incorporated with the drilling motor (120) such that they are substantially surrounded by a relatively non-magnetic material such as non-magnetic steel.

When the magnets (142) are incorporated with the drilling motor (120) they are preferably oriented so that their magnet axes (144) are both substantially parallel to each other and substantially perpendicular to the drilling motor axis (140). The magnets (142) are also preferably aligned in a common polar direction so that the magnetic fields generated by the magnets (142) are additive and collectively define a magnetic source axis which is parallel with the magnet axes (144).

The number and positions of the magnets (142) which are incorporated with the drilling motor (120) is preferably selected to accommodate the incorporation of the magnets (142) with the drilling motor (120) without adding to the length of the drilling motor (120), in order to avoid adverse effects upon the angle build rate and durability of the drilling assembly.

The principles of the invention may similarly be applied to other tools in order to provide an integrated tool which is adapted to perform both a drilling function and a magnetic field source carrying function.

The tools of the present invention are useful for performing drilling functions and for performing active magnetic ranging techniques.

Where the magnetic field source is comprised of one or more electromagnets the magnets may be energized by an alternating electrical source in order to produce a varying magnetic field which both allows for elimination of the effects of the earth's magnetic field and which provides a "signature" magnetic field which is discernible at a remote sensing location. The magnetic measurements which are made at the sensing location can be processed to determine the relative positions of the magnetic field source and a target location.

Where the magnetic field source is comprised of one or more permanent magnets which are oriented substantially perpendicular to the tool axis, rotation of the tool will generate a varying magnetic field which both allows for elimination of the effects of the earth's magnetic field and which provides a "signature" magnetic field which is discernible at a remote sensing location. The magnetic measurements which are made at the sensing location can be processed to determine the relative positions of the magnetic field source and a target location.

The embodiments of the invention in which an exclusive property or privilege is claimed are defined as follows:

1. A tool adapted for connection into a drilling string, wherein the tool is adapted to perform a first function in the drilling string, characterized in that the tool which comprises a magnetic field source incorporated with the tool so that the tool is adapted to perform a second function in the drilling string, wherein the second function is a magnetic field source carrying function, wherein the first function is unrelated to the magnetic field source carrying function, wherein the tool defines a tool axis, wherein the magnetic field source has a magnetic field source axis, and wherein the magnetic field source is incorporated with the tool such that the magnetic field source axis is substantially perpendicular to the tool axis.

2. The tool as claimed in claim 1 wherein the drilling string is comprised of a rotary drill bit and wherein the tool is adapted for connection into the drilling string for use in drilling with the rotary drill bit.

3. The tool as claimed in claim 2 wherein the magnetic field source is comprised of a permanent magnet.

4. The tool as claimed in claim 2 wherein the tool is constructed substantially from a relatively non-magnetic material.

5. The tool as claimed in claim 1 wherein the tool is a stabilizer, so that the first function is a stabilizing function.

6. The tool as claimed in claim 5 wherein the stabilizer is comprised of a stabilizer body and wherein the stabilizer is further comprised of a plurality of stabilizer members spaced circumferentially around the stabilizer body.

7. The tool as claimed in claim 6 wherein the magnetic field source is comprised of a plurality of magnets, wherein each of the magnets has a magnet axis, wherein the magnet axes or all of the magnets are substantially parallel to each other and are substantially perpendicular to the tool axis, and wherein each of the magnets is aligned in a common polar direction.

8. The tool as claimed in claim 7 wherein the plurality of magnets is each comprised of a permanent magnet.

9. The tool as claimed in claim 8 wherein the stabilizer defines stabilizer grooves spaced circumferentially between the stabilizer members and wherein each of the magnets extends transversely through the stabilizer body substantially between two of the stabilizer grooves.

10. The tool as claimed in claim 9 wherein the plurality of magnets is comprised of a first magnet array which extends transversely through the stabilizer body substantially between a first pair of the stabilizer grooves and wherein the plurality of magnets is further comprised of a second magnet array which extends transversely through the stabilizer body substantially between a second pair of the stabilizer grooves.

11. The tool as claimed in claim 10 wherein the stabilizer is constructed substantially from a relatively non-magnetic material.

12. The tool improvement as claimed in claim 2 wherein the tool is the rotary drill bit, so that the first function is a drilling function.

13. The tool improvement as claimed in claim 12 wherein the drill bit comprises:

(a) a plurality of rotary cutting elements located adjacent to a distal end of the drill bit;

(b) a threaded connector located adjacent to a proximal end of the drill bit, for connecting the drill bit with the drilling string; and (C) a shank located between the distal end of the drill bit and the proximal end of the drill bit.

14. The tool as claimed in claim 13 wherein the drill bit is constructed substantially from a relatively non-magnetic material.

15. The tool as claimed in claim 1 wherein the tool is a drilling motor, so that the first function is a drill bit driving function.

16. The tool as claimed in claim 15 wherein the drilling motor is adapted to drive a rotary drill bit.

17. The tool as claimed in claim 16 wherein the drilling motor is a positive displacement motor which comprises:

(a) a power section comprising a helically lobed rotor and a helically lobed stator, for imparting rotational energy to the rotor from a circulating fluid passed through the power section; and (b) a driveshaft connected with the rotor, for driving the rotary drill bit.

18. The tool as claimed in claim 2 wherein the magnetic held source is comprised of a plurality of magnets, wherein each of the magnets has a magnet axis, wherein the magnet axes of all of the magnets are substantially parallel to each other and are substantially perpendicular to the tool axis, and wherein each of the magnets is aligned in a common polar direction.

19. The tool as claimed in claim 18 wherein the plurality of magnets is each comprised of a permanent magnet.

20. The tool as claimed in claim 19 wherein the tool is constructed substantially from a relatively non-magnetic material.

21. The tool as claimed in claim 13 wherein the magnetic field source is comprised of a plurality of magnets, wherein each of the magnets has a magnet axis, wherein the magnet axes of all of the magnets are substantially parallel to each other and are substantially perpendicular to the tool axis, and wherein each of the magnets is aligned in a common polar direction.

22. The tool as claimed in claim 21 wherein the plurality of magnets is each comprised of a permanent magnet.

23. The tool as claimed in claim 22 wherein the drill bit has an exterior surface and wherein each of the magnets is mounted on the exterior surface of the drill bit.

24. The tool as claimed in claim 22 wherein the drill bit has an exterior surface, wherein the exterior surface defines a longitudinally oriented recess and wherein at least one of the plurality of magnets is positioned within the recess.

25. The tool as claimed in claim 24 wherein each of the magnets is mounted on the exterior surface of the drill bit.

26. The tool as claimed in claim 24 wherein the exterior surface of the drill bit defines a plurality of longitudinally oriented recesses spaced circumferentially around the exterior surface of the drill bit and wherein each of the magnets is positioned within at least one of the plurality of recesses.

27. The tool as claimed in claim 26 wherein each of the magnets is mounted on the exterior surface of the drill bit such that each of the magnets is positioned within one of the plurality of recesses.

28. The tool as claimed in claim 27 wherein the drill bit is constructed substantially from a relatively non-magnetic material.

29. The tool as claimed in claim 26 wherein each of the magnets extends transversely through the drill bit substantially between two of the recesses.

30. The tool as claimed in claim 29 wherein the plurality of magnets is comprised of a first magnet array which extends transversely through the drill bit substantially between a first pair of recesses and wherein the plurality of magnets is further comprised of a second magnet array which extends transversely through the drill bit substantially between a second pair of the recesses.

31. The tool as claimed in claim 30 wherein the drill bit is constructed substantially from a relatively non-magnetic material.

32. The tool as claimed in claim 17 wherein the magnetic field source is comprised of a plurality of magnets, wherein each of the magnets has a magnet axis, wherein the magnet axes of all of the magnets are substantially parallel to each other and are substantially perpendicular to the tool axis, and wherein each of the magnets is aligned in a common polar direction.

33. The tool as claimed in claim 32 wherein the plurality of magnets is each comprised of a permanent magnet.

34. The tool as claimed in claim 33 wherein the tool is constructed substantially from a relatively non-magnetic material.

* * * * *

UNITED STATES PATENT AND TRADEMARK OFFICE

CERTIFICATE OF CORRECTION

PATENT NO. : 7,321,293 B2
APPLICATION NO. : 11/133182
DATED : January 22, 2008
INVENTOR(S) : Timothy Wayne Kennedy et al.

It is certified that error appears in the above-identified patent and that said Letters Patent is hereby corrected as shown below:

Column 13, line 63, delete “which”.
Column 14, line 25, delete “or” and insert --of--.
Column 14, line 46, delete “improvement”.
Column 14, line 49, delete “improvement”.
Column 15, line 8, delete “held” and insert --field--.

Signed and Sealed this

Twenty-ninth Day of July, 2008

JON W. DUDAS
*Director of the United States Patent and Trademark Office*